United States Patent [19]

Krasuski et al.

[11] Patent Number: 4,718,809

[45] Date of Patent: Jan. 12, 1988

[54] DEVICE FOR UNSTACKING FLAT OBJECTS

[75] Inventors: Marek Krasuski, Fontenay Aux Roses; Michel Serruya, Paris; Pierre Milet, Champigny, all of France

[73] Assignee: SMH Alcatel, Paris

[21] Appl. No.: 839,241

[22] Filed: Mar. 13, 1986

[30] Foreign Application Priority Data

Mar. 13, 1985 [FR] France ..... 8503685

[51] Int. Cl.[4] ..... B65H 3/54

[52] U.S. Cl. ..... 414/129; 271/121; 271/125

[58] Field of Search ..... 271/10, 111, 121, 124, 271/125; 414/129, 130

[56] References Cited

U.S. PATENT DOCUMENTS

| | | | |
|---|---|---|---|
| 1,919,238 | 7/1933 | McCarthy | 271/10 X |
| 2,368,519 | 1/1945 | Burckhardt et al. | 271/125 X |
| 2,740,629 | 4/1956 | Harred | 271/134 |
| 3,219,339 | 11/1965 | Guiterrez | 271/11 |
| 3,949,981 | 4/1976 | McInerney | 271/178 |
| 3,988,017 | 10/1976 | Kyhl | 271/10 X |
| 4,083,555 | 4/1978 | Irvine et al. | 271/10 |
| 4,284,269 | 8/1981 | Ignatjev | 271/122 |
| 4,573,673 | 3/1986 | Haug | 271/10 X |
| 4,666,140 | 5/1987 | Godlewski | 271/125 X |

FOREIGN PATENT DOCUMENTS

| | | | |
|---|---|---|---|
| 0060596 | 9/1982 | European Pat. Off. | |
| 178535 | 5/1954 | Fed. Rep. of Germany | 414/129 |
| 2173543 | 10/1973 | France . | |
| 55-52835 | 4/1980 | Japan | 271/121 |
| 13034 | 1/1982 | Japan | 271/111 |
| 534092 | 4/1973 | Switzerland . | |
| 1162011 | 8/1969 | United Kingdom | 414/130 |
| 2057404 | 4/1981 | United Kingdom . | |

OTHER PUBLICATIONS

Patents Abstracts of Japan, vol. 7, No. 237 (M-250) (1382), Oct. 21, 1983, JP-A-58 125543 (Yoshikazu Yui), 26/7/83.

*Primary Examiner*—Frank E. Werner
*Assistant Examiner*—Janice Krizek
*Attorney, Agent, or Firm*—Sughrue, Mion, Zinn, Macpeak & Seas

[57] ABSTRACT

The unstacking device comprises an object magazine (2), an object transport conveyor (7) for removing objects from the magazine, an object separator assembly (20) mounted in front of the object outlet from the magazine above the transport conveyor and comprising firstly a retaining element constituted by at least one flexible end tongue (34) mounted on a deflector flap (31) carried by a pivoting arcuate arm (32) which is resiliently urged by a spring (38), and secondly a part constituting a separator shoe (40) carried by a second pivoting arm (41) which is resiliently urged by a second spring (45), an object extractor (50), and detector for (55, 56) for detecting when objects are engaged in said object extractor in order to stop said conveyor (7).

6 Claims, 1 Drawing Figure

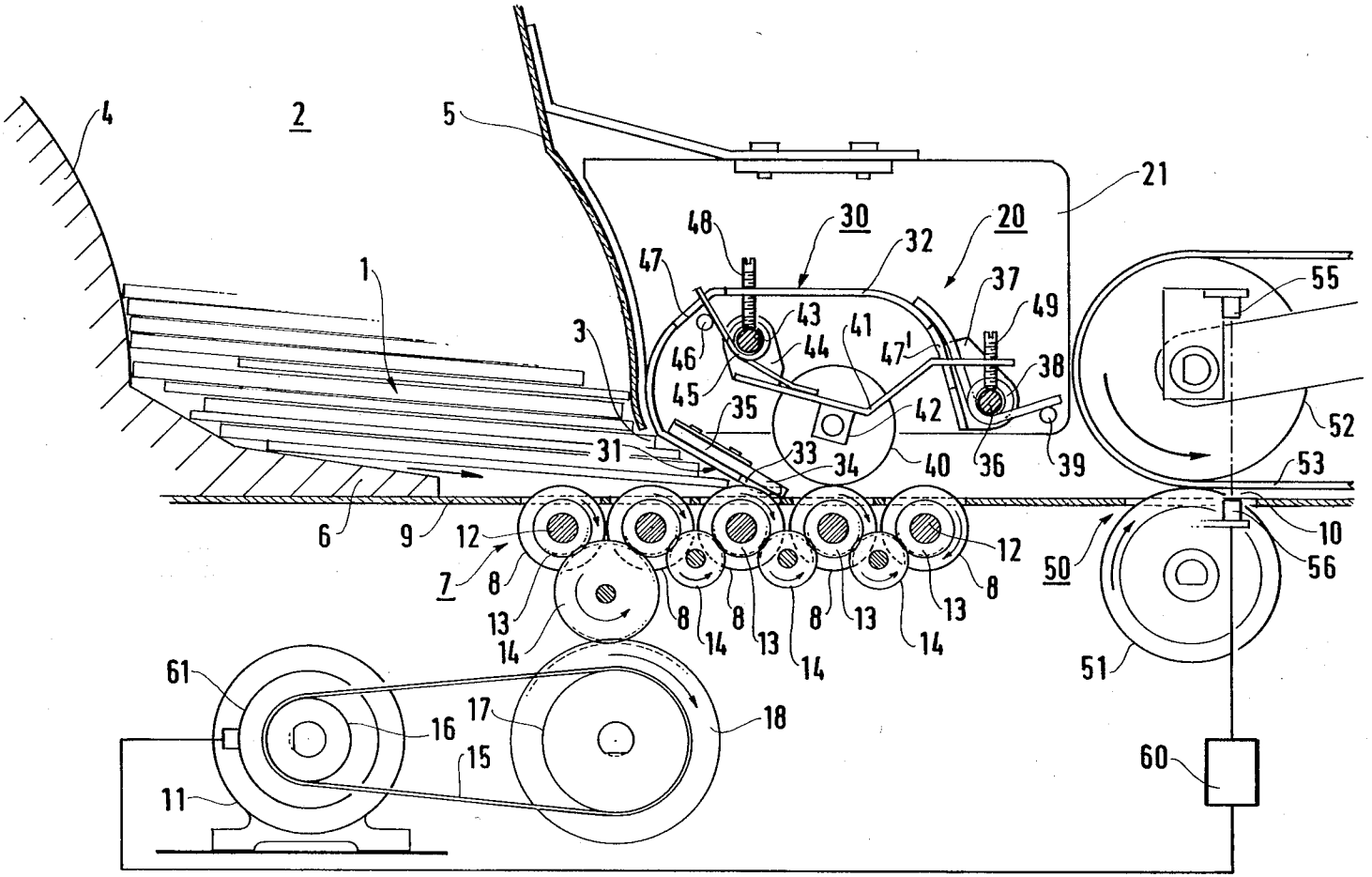
55
52
53
10
56
60
51
50
21
20
30
32
37
49
38
39
36
42
40
41
47'
34
33
43
44
35
48
46
45
47
31
3
5
1
2
4
6
9
7
12
8
13
14
18
17
15
16
61
11

DEVICE FOR UNSTACKING FLAT OBJECTS

The present invention relates to devices for unstacking flat objects, which devices are intended to take objects from a stack in a magazine and to deliver them separately from each other to a transport mechanism. The invention is particularly applicable to mail processing machines, and in particular to franking machines for inserting envelopes one after another into such machines.

In automatic mail processing installations, once letters have been inserted into envelopes, the operations related to the above-mentioned franking operation consists essentially in moistening the envelope flaps, in closing the envelopes, and then in franking them. These operations are performed on envelopes moving along a transport mechanism, after said envelopes have been taken from a magazine and delivered one after the other by an unstacking device feeding the transport mechanism. In order to moisten their flaps in known manner, the envelopes are advantageously driven flat on the transport mechanism from which their flaps overhang, hang down freely, and are guided against a moistener placed under the transport mechanism. It is thus advantageous for the envelopes to be unstacked in such a manner as to enable them to be directly placed flat on the transport mechanism.

For this moistening operation and subsequent operations, it is essential that the envelopes arrive separately from one another on the transport mechanism. The unstacking device must therefore separate them effectively, regardless of the lengths of the envelopes and regardless of the thicknesses and weights of the envelopes with their contents, and throughout account must be taken of the problem posed by the varying degrees of adherence between successive envelopes in a stack. U.S. Pat. No. 1,955,066 describes an unstacking device which meets these objectives. In this device, the envelopes are stored in a stack in a magazine. A horizontal transport conveyor which partially overlaps under the stack of envelopes in the magazine removes the envelopes from the magazine by friction and conveys them towards a processing machine. A separator wheel positioned above the transport conveyor, in the vicinity of the outlet of the envelopes from the magazine and caused to rotate in such a direction as to exert a force on the envelopes in the opposite direction to the force exerted by the transport conveyor serves to separate envelopes which may be superposed when they arrive thereat. An envelope-retaining element disposed above the transport conveyor between the separator wheel and the envelope outlet serves to limit the number of envelopes which leave the magazine simultaneously. Downstream from the separating wheel, the envelopes are driven at a speed greater than the speed at which they are driven while being extracted from the magazine and separated, thereby increasing the gap between successive envelopes delivered to a subsequent processing machine, and consequently contributing to envelope separation.

In this unstacking device, the retaining element and the separator wheel are resiliently held above the transport conveyor. The retaining element constitutes a rounded "heel" on the lower portion of the envelope outlet and has a rough or toothed surface for retaining superposed envelopes together with lugs extending over the transport conveyor with the separator wheel being received between said lugs. This retaining element is slidably mounted on a support fixed in front of the magazine outlet and is urged towards the transport conveyor by springs mounted between the support and said retaining element.

Beneath the retaining elements, the transport conveyor is constituted by toothed belts which co-operate with each of the lugs of the retaining element, and a central belt which co-operates with the separator wheel.

This mechanism is complex, and in addition it requires the supports of the retaining element and of the separator wheel to be respectively mounted so that the separator wheel is suitably received between the lugs of the retaining element while taking account of the thickness of the types of envelope to be separated from one another. Furthermore, when only one envelope arrives at the separator wheel, the separator wheel causes opposing forces to be applied to its two faces, and this may damage the envelope. Such possible damage to the envelopes may also damage letters contained therein if the envelopes are full at the time.

The aim of the present invention is thus to provide an unstacking device of very simple structure which is easily adjustable if necessary and which enables objects to be separated with optimum performance regardless of the length or width of the objects.

The present invention thus provides a device for unstacking flat objects, said device comprising a magazine for storing a stack of said objects and having an object outlet at the bottom of the stack, a transport conveyor for the objects constituted by a series of rolls which are driven in rotation and which are disposed beneath the object outlet on either side thereof, an object separator means disposed downstream from said object outlet and resiliently mounted above said transport conveyor, an object retainer element disposed between said object outlet and said separator means, and resiliently mounted above said transport conveyor, and separated object extractor means disposed downstream from said separator means, said device being characterized in that said retainer element is constituted by at least one flexible end tongue carried by a part which defines firstly an inclined rigid deflector flap substantially at the same height as said object outlet and extending said outlet and having an end which is substantially tangential to one of the rolls of said transport conveyor, thereby constituting an inclined smooth surface presser against said objects, which presser is equipped with said retaining element which overhangs said flap and falls onto said conveyor upstream from said separator means, and secondly a substantially C-shaped arcuate arm above said object outlet and having a terminal portion opposite to the retaining element which is pivotally mounted about a first fixed shaft and is urged by a first return spring for returning said deflector flap towards said conveyor, in that said separator means is constituted by another part whose portion facing the conveyor constitutes a separator shoe carried by a lever arm having one end portion pivotally mounted about a second fixed axis and urged by a second return spring returning the part constituting the separator shoe towards said conveyor, and in that it additionally comprises detector means for detecting an object engaged by said extractor means and controlling the stopping of said transport conveyor on each occasion that an object is detected as being engaged in said extractor means.

According to a preferred feature of the unstacking device, said deflector flap equipped with said retaining elements and said part constituting the shoe are both mounted on a common support bearing said first and second axes about which they pivot respectively, and constitute an add-on pre-adjusted assembly which is maintained in front of said object outlet.

Other characteristics and advantages of the present invention will appear from the description of an embodiment given by way of example and shown in the sole FIGURE of the accompanying drawing.

This FIGURE is a diagram of an unstacking device in accordance with the invention. Reference 1 designates a stack of flat objects, in particular a stack of envelopes filled with their respective letters, and not yet closed. The stack of objects is stored in a magazine 2 from which the objects are removed through an object outlet 3 at the bottom of the stack, and are then delivered flat and separate from one another.

In the magazine 2 of the unstacking device, the objects are stacked in staggered manner. To this end, the magazine 2 has first side wall 4 opposite from the object outlet 3 and shown diagrammatically in the FIGURE, and a second wall 5 delimiting the outlet 3, which side walls have their inside faces profiled and extending generally at an angle to the vertical in order to encourage said object stagger. The upwards extent of the wall 4 constitutes a slightly convex sliding slope over which the objects sliding towards the outlet 3 are guided by one of their small edges. In addition, this wall 4 has a terminal portion 6 which is connected to the sliding slope and which forms a slope inclined relative to the horizontal and leading towards the outlet. This terminal portion 6 constitutes part of the bottom of the magazine, and it is not adjacent to the object outlet. The inside face of the wall 5 has substantially the same slope as the inside face of the wall 4. It is slightly concave and above the outlet 3 it constitutes an oblique retaining abutment for the objects.

A horizontal object transporting conveyor 7 is mounted on either side of the object outlet 3. Upstream therefrom it constitutes, together with the terminal portion 6, the bottom of the magazine; the stacks and staggered objects rest on the upper surface of the terminal portion and on said upstream portion of the conveyor belt whose end adjacent to said terminal portion lies substantially in the extension thereof.

The transport conveyor 7 is constituted by a series of rolls such as 8 mounted under a table 9 extending at least along the length of the unstacking device and over which the outlet 10 from the unstacking device is defined downstream from the object outlet 3 from the magazine. The side wall 4 and its terminal portion 6 stand on said table and are fixed thereto in such a manner as to be adjustable relative to the wall 5. The rolls 8 of the transport conveyor 7 have their peripheries slightly above the top of the table 9 by means of unreferenced slots provided therethrough. The first row 8, inside the magazine, has its top portion substantially in line with the slope defined by the top surface of the terminal portion 6.

The rolls 8 are coupled to one another and to a drive motor 11. To this end, the axes 12 of rolls 8 have first gear wheels 13 meshing in pairs on second gear wheels 14. One of the terminal second gear wheels is coupled to the motor 11. For the sake of clarity in the FIGURE, this coupling is shown as being provided by a drive belt 15 mounted between a wheel 16 on the motor shaft and a pickup wheel 17 whose shaft carries a drive gear wheel 18 meshing with said terminal second gear wheel. The directions of rotation of the gear wheels and the rolls are shown by non-referenced arrows drawn on said items. When the rolls 8 are being driven, the rolls inside the magazine cause the object which they are supporting together with the terminal portion 6 to advance, or else they cause a plurality of more or less superposed objects to advance through the object outlet 3.

These rolls 8 are rubber rolls or rubber-coated rolls, in order to have a high coefficient of friction against the objects, which coefficient of friction is greater than that between objects themselves. In addition, the rolls are advantageously each carried on their respective shafts 12 by means of free wheels (not shown) fixed to the corresponding first gear wheel 13. In order to facilitate the appearance and clarity of the FIGURE, only the peripheral outlines of the rolls 8 are shown and the various gear wheels are marked diagrammatically.

The outlet 10 for the unstacking device is separated from the object outlet 3 from the magazine by a distance substantially equal to the minimum length of the objects to be unstacked. An object separator assembly 20 and an object extractor means 50 are mounted one after the other between said outlets 3 and 10.

The object separator assembly 20 is an assembly which is pre-mounted on a support 21 and then added to the side wall 5 of the magazine to which its top portion is fixed, as shown. This assembly 20 is essentially constituted by a part 30 whose portion defines an element for retaining superposed objects. This part is resiliently and adjustably mounted and is followed by a part 40 whose bottom portion constitutes a separator shoe which is likewise resiliently and adjustably mounted and which co-operates with two of the rolls 8 of the transport conveyor 7 downstream from the outlet 3.

The part 30 is arcuate in shape and fits substantially closely round the profile of the terminal portion of the side wall 5 which delimits the object outlet 3 and it is held in front of said wall by the support 21. On either side of this terminal portion of the side wall 5, the part 30 defines a rigid deflector flap 31 on the object outlet 3 and above the conveyor 7, and a generally C-shaped curved arm 32 for suitably maintaining the deflector flap facing the conveyor.

The end of the rigid deflector flap 31 arrives substantially tangentially against the roll 8 of the conveyor 7 with which it co-operates. This end of the deflector flap has a plurality of terminal teeth 33 which are separated from one another and which curve slightly upwardly. The bottom arcuate portions of these teeth mesh partially in pairs in the corresponding roll 8 which is provided, to this end, with slightly deeper grooves (not shown). Flexible end tongues 34 belonging to a flexible strip 35 fixed to the back of deflector flap 31 extend between each pair of teeth in the corresponding groove of the roll 8.

The inclined deflector flap which extends the outlet 3 has a smooth surface and constitutes a low coefficient of friction presser against the objects. The flexible overhanging end tongues which fall onto the roll constitute an object-retaining element associated with the presser on which they are mounted.

The end of the C-shaped arm 32 is pivotally mounted on fixed shaft 36 carried by the support 21 by means of a fixing lug 37. In addition, its end portion is urged by a spring 38 wound round the shaft 36 and having its end lengths applied on either side of the shaft 36 against the arm 32 and against a retaining peg 39. This pivoting arm 32 thus resiliently urges the end of the deflector flap against the conveyor 7.

The part constituting the separator shoe 40 and shown in the form of a wheel in the drawing is mounted on a lever arm 41 by means of a fixing lug 42 for the wheel shape given thereto. One of the ends of this lever arm is likewise pivotally mounted about a fixed shaft 43 carried by the support 21 by means of another retaining lug 44. The same terminal portion of the lever arm 41 is additionally urged by a spring 45 wound round the shaft 43 and having its terminal ends pressing on respective sides of the shaft 43, against the lever arm and against a retaining peg 46, respectively. A cutout 47 in the C-shaped arm 32 of the retaining element 30 allows the end length of the spring 45 which does not bear against the lever arm 41 to pass therethrough.

The part constituting the separator shoe 40 opposite the associated roll 8 is advantageously made of rubber in order to have a high coefficient of friction against the objects. Although it has been shown in the form of a wheel, it may have some other shape, simply being concave on its deflector flap side and having a surface for rubbing against the objects opposite to the roll 8.

As illustrated, the part 30 constituting the presser and the retaining element, and the part 40 constituting the separator shoe, are advantageously mounted together on a preadjusted assembly 20 on the support 21. On this support 21 these parts are advantageously individually adjustable in resilient positioning above their associated rolls 8. To this end, the C-shaped arm 32 has a hole through which an adjusting screw 48 is passed for abutting against a fixed element carried by the support 21, in this case the fixed shaft 43 on which the lever arm 41 pivots. This screw 48 serves to adjust the position of the end of the flap against the conveyor, and thus its distance relative to the conveyor. Similarly, the lever arm 41 of the separator shoe forming part 40 also has a hole through its end opposite to that urged by the spring 45, which passes through a suitable cutout 47' in the C-shaped arm 32. An adjusting screw 49 passes through this hole in the arm 41 and abuts against a fixed element carried by the support, in this case the fixed pivot shaft 36, in order to adjust the position of the shoe forming part 40 against its roll 8 and against the effect of the spring 45.

The object extractor means 50 feeds the outlet 10 of the unstacking device with objects which are separated from one another. It is constituted by a wheel 51 which may be driven or free about a shaft passing under the table 9 so that the periphery of the wheel 51 passes through a suitable slot to lie just above the table, together with a drive or return wheel 52 connected to a drive belt 53. The belt 53 and the wheel 51 are urged against one another in order to pinch objects coming from the separator assembly 20. The belt 53 is also driven at a linear speed which is greater than the speed of the objects passing through the separator. The motor 11 driving rolls of the conveyor 7 may also be used to drive the wheel 52, and where applicable the wheel 51, by means of suitable couplings.

In addition, this extractor means 50 is associated with a device for detecting when one of the objects is engaged between the wheel 51 and belt 53. This detector device is constituted by a light cell 55 and a photodetector 56 mounted on either side of the object path just downstream from the region where the belt 53 and the wheel 51 are tangential to each other, and slightly offset from the edge of the belt 53. As soon as the edge of an object is pinched in the extractor means and arrives under the cell 55, the photodetector detects that an object is engaged in the extractor means.

The photodetector is connected to a device 60 for stopping drive to the rolls 8 of the conveyor 7, which is coupled to this end to an electromagnetic clutch 61 mounted on the shaft of the motor 11. This control device 60 may include a fixed or adjustable timeout for removing drive from the rolls 8 as soon as object engagement has been detected and drive may be removed therefrom for a fixed period or for a period which is adjusted to obtain a desired spacing between successive objects at the outlet 10, which spacing is compatible with the processing to be performed downstream from the outlet 10.

Thus, only the object whose leading edge is pinched in the extractor means is driven by said extractor means to the outlet 10 from the unstacking device. Selecting the extraction speed to be greater than the speed at which the objects are transported when being taken from the magazine and when being separated, if need be, facilitates disengaging a single object, and consequently accentuates the separation effect obtained upstream by the assembly 20.

The arrangement of this unstacking device, in accordance with the invention, constitutes a device which is mechanically very simple, which is compact, which is pre-adjusted, which may be further adjusted in situ, and which is technically suitable for unstacking objects regardless of the lengths and their thicknesses. Although the invention has been described with reference to the embodiment shown in the accompanying drawing, it is obvious that detail modifications may be made thereto and/or that certain means may be replaced by other technically equivalent means without going beyond the scope of the invention.

We claim:

1. In a device for unstacking flat objects, said device comprising a magazine for storing a stack of said objects and having an object outlet at the bottom of the stack, a transport conveyor for the objects constituted by a series of rolls which are driven in rotation and which are disposed beneath the object outlet both upstream and downstream thereof, an object separator means disposed downstream from said object outlet and resiliently mounted above said transport conveyor, an object retainer element disposed between said object outlet and said separator means and resiliently mounted above said transport conveyor, and separate object extractor means disposed downstream from said separator means, the improvement wherein said retainer element is constituted by at least one flexible end tongue (34) carried by a part (30) which includes firstly an inclined rigid deflector flap (31) substantially at the same height as said object outlet and extending said outlet and having an end which is substantially tangential to one of the rolls of said transport conveyor (7) thereby constituting an inclined smooth surface presser against said objects, which deflector flap is equipped with said tongue which overhangs said flap and falls onto said conveyor upstream from said separator means (40), and secondly a substantially C-shaped arcuate arm (32) above said object outlet having a terminal portion opposite to the retainer element which is pivotally mounted about a first fixed shaft (36) and a first return spring (38) for biasing said deflector flap towards said conveyor, said separator means is constituted by another part having a portion facing the conveyor forming a separator shoe (40), said separator shoe being of a material having a high coefficient of friction and being fixedly mounted onto a lever arm (41) having one end portion pivotally mounted about a second fixed shaft (43) and a second return spring (35) biasing the part constituting the separator shoe against said conveyor, and detector means (55, 56) for detecting an object engaged by said extractor means (50) and controlling the stopping of said transport conveyor (7) on each occasion that an object is detected as being engaged in said extractor means.

2. An unstacking device according to claim 1, characterized in that said part (30) carrying the retaining element (34) and constituting said deflector flap (31) and said part constituting the separator shoe (40) are both mounted on a support (21) carrying their said first and second shafts (36, 43) about which they pivot respectively and forming a pre-adjusted add-on assembly mounted downstream of said object outlet (3) and above said transport conveyor.

3. An unstacking device according to claim 2, characterized in that said arms (32, 41) are individually equipped with means (48, 49) for adjusting the resilient position of said object retainer element and of said part constituting the separator shoe (40) against said transport conveyor.

4. An unstacking device according to claim 3, characterized in that said individual adjustment means are each constituted by a screw (48, 49) mounted through a hole in the corresponding arm (32, 41) and in abutment against a said first and second shafts (43, 36) carried by said support (21).

5. An unstacking device according to claim 1 or 4, characterized in that each of said first and second springs (38, 45) is mounted about the corresponding fixed pivot shaft (36, 43) and presses on either side of said pivot shaft against the corresponding arm (32, 41) and a fixed retaining peg (39, 46).

6. An unstacking device according to claim 1, characterized in that said extractor means (50) is disposed at a distance from said object outlet (3) from the magazine, which distance is less than the minimum length of the objects.

* * * * *